US006224282B1

(12) United States Patent
Ueki

(10) Patent No.: US 6,224,282 B1
(45) Date of Patent: May 1, 2001

(54) SIDE KNOCK-TYPE BALL POINT PEN

(75) Inventor: Tomiji Ueki, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/472,597

(22) Filed: Dec. 27, 1999

(30) Foreign Application Priority Data

Dec. 25, 1998 (JP) ..... 10-368964

(51) Int. Cl.[7] ..... B43K 24/02
(52) U.S. Cl. ..... 401/109; 401/110; 401/111
(58) Field of Search ..... 401/109, 110, 401/111, 65, 67, 99, 112, 104, 105

(56) References Cited

U.S. PATENT DOCUMENTS 2,722,914 * 11/1955 Aversa ..... 401/105
3,318,289 * 5/1967 Marynissen ..... 401/110
5,074,694 * 12/1991 Nakazato et al. ..... 401/104

* cited by examiner

*Primary Examiner*—David J. Walczak
(74) *Attorney, Agent, or Firm*—McGinn & Gibb, PLLC

(57) ABSTRACT

A side knock-type ball point pen includes a barrel having a front end portion and a rear end portion, a refill-receiver member axially movably incorporated within the barrel, a refill removably received in the refill-receiver member, the refill including an ink container-tube, a writing tip attached to a front end of the ink container-tube, and ink contained in the ink container-tube, a first cooperating mechanism provided in an interior of the rear end portion of the barrel for preventing the refill-receiver member from rotating relative to the barrel, a second cooperating mechanism provided in an interior of the rear end portion of the barrel for keeping the writing tip of the refill projected out of the barrel in use of the ball point pen, the refill-receiver member coupled to the second cooperating mechanism, and an actuator member provided at a portion of a peripheral wall of the barrel for causing the refill-receiver member to be advanced.

12 Claims, 9 Drawing Sheets

SIDE KNOCK-TYPE BALL POINT PEN

BACKGROUND OF THE INVENTION

1. Field of the Invention

This invention relates to a side knock-type ball point pen in which a writing tip is adapted to be projected out of a ball point pen barrel by operating actuator means which is received in an opening portion formed in a portion of a peripheral wall of the ball point pen barrel.

2. Description of the Prior Art

Hitherto, there have been proposed rear end knock-type ball point pens and side slide-type ball point pens. However, a side knock-type ball point pen is not proposed yet. An example of the side slide-type ball point pens is disclosed in Japanese Utility Model Application which was published under Publication No. 32394/1994 on Aug. 24, 1994.

Referring now to FIG. 1, the conventional side slide-type ball point pen will be discussed in order to facilitate understanding of the present invention. The conventional side slide-type ball point pen includes a barrel 1, a head section 2 attached to a front end of the barrel 1, a refill 4 axially movably received in the barrel 1, a cam mechanism 5 for keeping a writing tip 4*a* of the refill 4 projected out of the head section 2 in use of the ball point pen, the cam mechanism 5 provided in a portion of an interior of the barrel 1 which positionally corresponds to a portion of the barrel 1 which is to be gripped by a user in use, and a slide plate 6 slidably received in an elongate hole 7 which is formed in a portion of a peripheral wall of the barrel 1, the slide plate 6 coupled to the cam mechanism 5. In the conventional ball point pen, the writing tip 4*a* of the refill 4 is projected out of the head section 2 by causing the slide plate 6 to be slid along the elongate hole 7 and kept projected out of the head section 2 by the cam mechanism 5.

In the conventional ball point pen, the cam mechanism which is complex in construction is disposed at the portion of the interior of the barrel 1 which positionally corresponds to the portion of the barrel 1 which is to be gripped by the user, so that the portion of the barrel 1 which is to be gripped by the user is inevitably fat. This causes the user to be fatigued in use of the ball point pen and causes an appearance of the ball point pen to be unshapely. In addition, since the cam mechanism 5 is complex in construction, it takes a lot of labor to incorporate the cam mechanism 5 into the barrel 1. Therefore, manufacturing cost of the ball point pen rises.

SUMMARY OF THE INVENTION

The present invention has been made with a view to overcoming the foregoing problems of the prior art ball point pen.

It is therefore an object of this invention to provide a side knock-type ball point pen in which a portion of a barrel of the side knock-type ball point which is to be gripped by a user in use of the ball point pen is not fat.

It is another object of this invention to provide a side knock-type ball point pen which can ensure a user's comfortable gripping of a barrel of the ball point pen so as not to cause a user to be fatigued in use of the ball point pen.

It is still another object of this invention to provide a side knock-type ball point pen which can be easily manufactured.

BRIEF DESCRIPTION OF THE DRAWINGS

These and other objects and many of the attendant advantages of the present invention will be readily appreciated as the same become better understood by reference to the following detailed description when considered in connection with the accompanying drawings, in which like reference numerals designate the same parts throughout the Figures and wherein.

DETAILED DESCRIPTION OF THE PREFERRED EMBODIMENTS

A side knock-type ball point pen according to the present invention will be discussed hereinafter with reference to the accompanying drawings.

Figure 2:
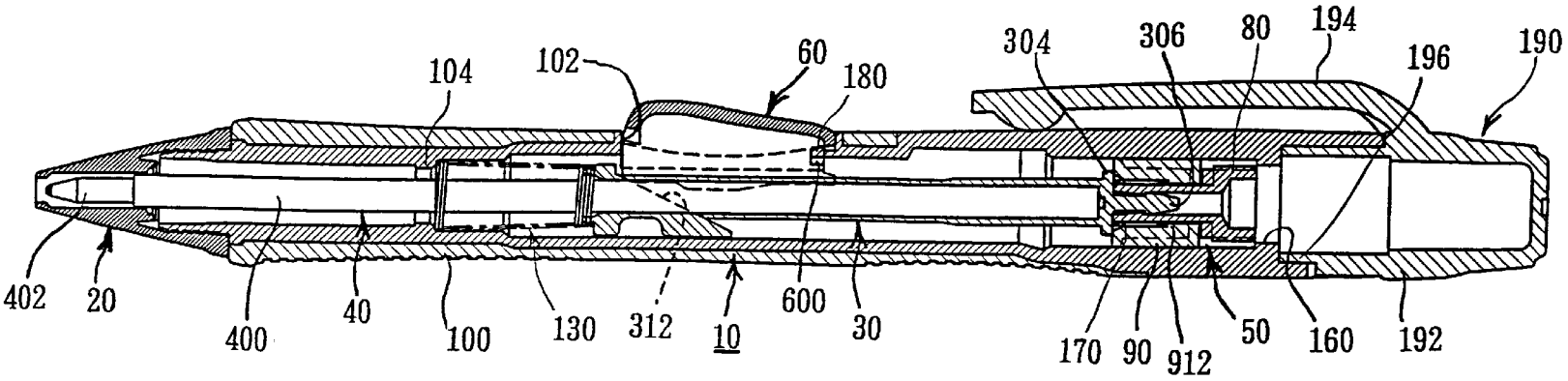
FIG. 2 is a schematic longitudinal sectional view of a side knock-type ball point pen according to a first embodiment of the present invention, in which a writing tip is retracted in a barrel of the ball point pen.
Figure 3:
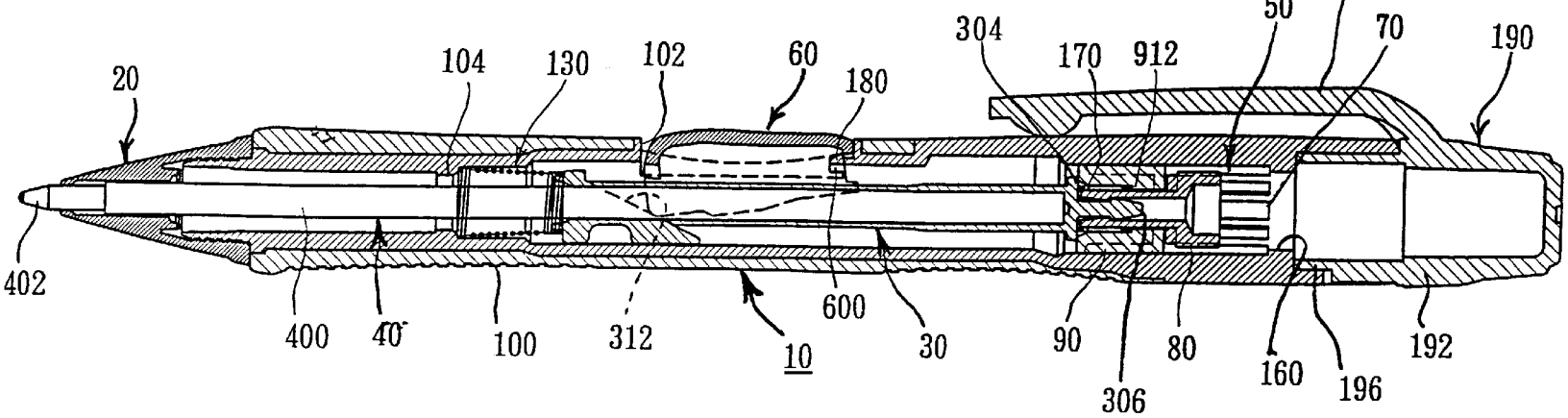
FIG. 3 is a schematic longitudinal sectional view of the side knock-type ball point pen of FIG. 2, in which the writing tip is projected out of a head section.

Referring to FIGS. 2 and 3, there is illustrated a side knock-type ball point pen according to a first embodiment of the present invention. The ball point pen generally includes a barrel 10, a head section 20 attached to a front end portion of the barrel 10, refill-receiver means 30 axially movably incorporated within the barrel 10, a refill 40 removably received in the refill-receiver means 30, the refill 40 comprising an ink container-tube 400, a writing tip 402 attached to a front end of the ink container-tube 400, and ink contained in the container-tube 400, first cooperating means on the barrel 10 and the refill-receiver means 30 for preventing the refill-receiver means 30 from rotating relative to the barrel 10, second cooperating means 50 provided in an interior of the barrel 10 for keeping the writing tip 402 of the refill 40 projected out of the head section 20 in use of the ball point pen, the refill-receiver means 30 being coupled to the second cooperating means 50, and actuator means 60 for causing the refill-receiver means 30 to be moved forwardly.

In the illustrated embodiment, the barrel 10 is produced by two-color molding or double shot molding. The barrel 10 comprises an elongated cylindrical body 100. The cylindrical body 100 has an opening portion 102 formed in a region of a peripheral wall of the elongated cylindrical body 100 and an inner circumferential step portion 104 provided around an inner peripheral portion of the cylindrical body 100 which is adjacent the front end of the cylindrical body 100.

Figure 1:
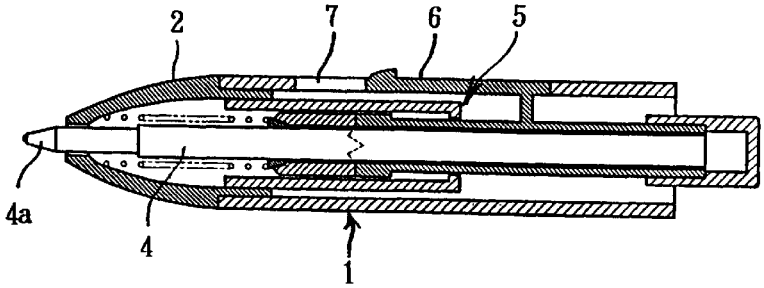
FIG. 1 PRIOR ART
FIG. 1 is a schematic longitudinal sectional view of assistance in explaining a conventional ball point pen.
Figure 4:
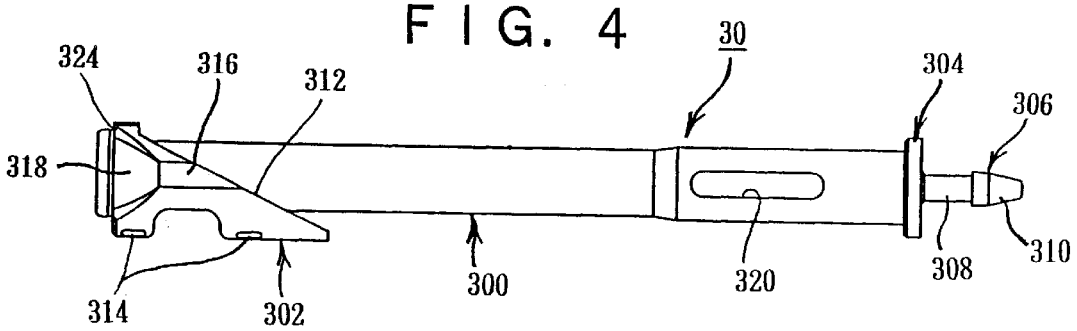
FIG. 4 is a schematic view of refill-receiver means of the side knock-type ball point pen.
Figure 5:
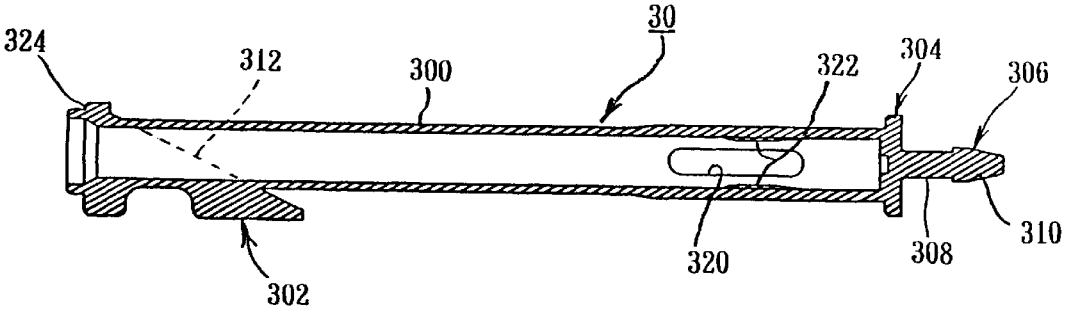
FIG. 5 is a schematic longitudinal sectional view of the refill-receiver means of FIG. 4.

Referring to FIGS. 4 and 5, there is illustrated the refill-receiver means 30. The refill-receiver means 30 comprises a cylindrical body 300 having an opened end and a closed end, an enlarged outer diameter portion 302 provided around the opened end of the cylindrical body 300, a flange portion 304 provided around the closed end of the cylindrical body 300, and an engaging protrusion 306 provided at the closed end of the cylindrical body 300. The engaging protrusion 306 comprises a stem portion 308 projecting rearwardly from the closed end of the cylindrical body 300, and a substantially cone-shaped portion 310 provided at a free end of the stem portion 308. The enlarged outer diameter portion 302 has a slant surface 312 which is inclined relative to a longitudinal axis of the cylindrical body 300 and slopes in a rearward direction, and projections 314 provided on both sides of the enlarged outer diameter portion 302 and projecting laterally from the both sides of the enlarged outer diameter 302.

Figure 6A:
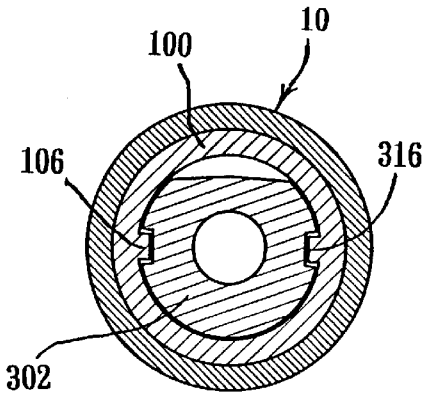
FIG. 6A is a schematic cross-sectional view of assistance in explaining first cooperating means of the side knock-type ball point pen.

As shown in FIGS. 4 and 6A, the first cooperating means comprises a pair of axially extending guide grooves 316 formed in the both side of the enlarged outer diameter portion 302 of the refill-receiver means 30 (only one guide groove 316 is shown in FIG. 4), and a pair of axially extending ribs 106 provided on inner surface portions of the cylindrical body 100 which are opposite to each other. The refill-receiver means 30 is incorporated within the barrel 10 with the guide grooves 316 of the enlarged outer diameter portion 302 being engaged with the axially extending ribs 106 of the barrel 10, so that the refill-receiver means 30 can be axially moved along the axially extending ribs 106 of the barrel 10, but the refill-receiver means 30 is prohibited to rotate relative to the barrel 10.

Figure 6B:
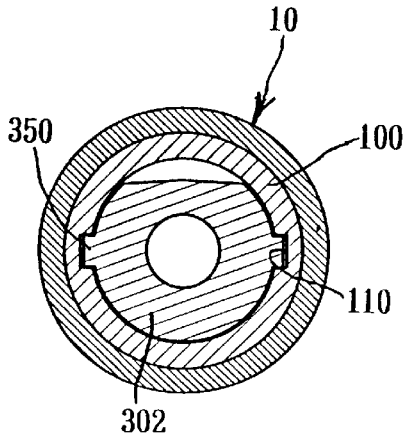
FIG. 6B is a schematic cross-sectional view of assistance in explaining a modification of the first cooperating means shown in FIG. 6A.

Referring now to FIG. 6B, there is illustrated a modification of the first cooperating means. The modification is different from the first cooperating means of FIGS. 4 and 6A in that a pair of axially extending guide grooves 110 of the modification are formed in inner surface portions of the cylindrical body 100 which are opposite to each other, and a pair of axially extending ribs 350 of the modification are provided at the both sides of the enlarged outer diameter portion 302 of the refill-receiver means 30.

As shown in FIG. 4, the enlarged outer diameter portion 302 of the refill-receiver means 30 further has a pair of introducing grooves 318 which are formed in the both sides of the enlarged outer diameter portions 302 and spread forwardly from ends of the guide grooves 316 as continuations of the guide grooves 316 (only one introducing groove 318 is shown in FIG. 4). The introducing grooves 318 of the enlarged outer diameter portion 302 serve as means to facilitate introducting of the ribs 106 of the barrel 10 into the guide grooves 316 of the enlarged outer diameter portion 302 when the refill-receiver means 30 is incorporated into the barrel 10. The refill-receiver means 30 incorporated within the barrel 10 is in point-contact with an inner surface of the barrel 10 at the laterally protruding projection 314, so that friction force which may be produced during axial movement of the refill-receiver means 30 can be reduced. Therefore, the refill-receiver means 30 can be smoothly slid within the barrel 10. The cylindrical body 300 of the refill-receiver means 30 has a pair of elongated holes 320 formed in regions of a peripheral wall of the cylindrical body 300 which are adjacent the flange portion 304 and opposite to each other, and a pair of inwardly protruding portions 322 provided on inner surface regions of the peripheral wall of the cylindrical body 300 which are opposite to each other (see FIG. 5). The elongated holes 320 and the inwardly protruding portions 322 are alternately disposed around the peripheral wall of the cylindrical body 300. The inwardly protruding portions 322 serve as means to tightly hold the ink container-tube 400 of the refill 40 when the refill 40 is inserted in the cylindrical body 300 of the refill-receiver mean 30. The peripheral wall portions of the cylindrical body 300 in which the elongated holes 320 are formed can be deformed radially. Therefore, although the cylindrical body 300 has the inwardly protruding portions 322, the insertion of the refill 40 into the cylindrical body 300 of the refill-receiver means 30 can be easily performed while causing the peripheral wall portion of the cylindrical body 300 to be deformed outwardly.

Again referring to FIGS. 2 and 3, disposed between the inner circumferential step portion 104 of the barrel 10 and a circumferential step portion 324 of the refill-receiver means 30 (FIGS. 4 and 5) is a first spring 130 which always urges the refill-receiver means 30, having the refill 40 receiver therein, in the rearward direction.

The second cooperating means 50 comprises a circumferential cam body 70 formed around an inner peripheral portion of the barrel 10 which is adjacent a rear end of the barrel 10, a first cam element 80 incorporated within the barrel, and a second rotary cam element 90 incorporated within the barrel 10.

Figure 7:
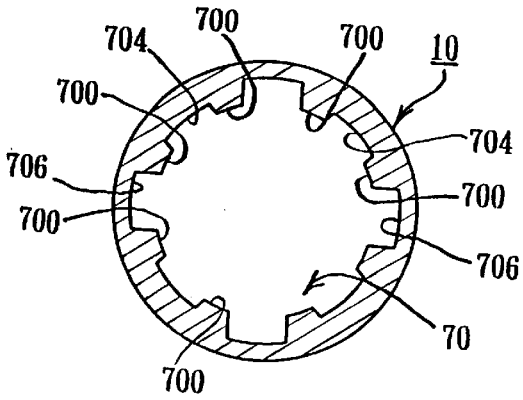
FIG. 7 is a schematic cross-sectional view of assistance in explaining a cam body of the side knock-type ball point pen.
Figure 8:
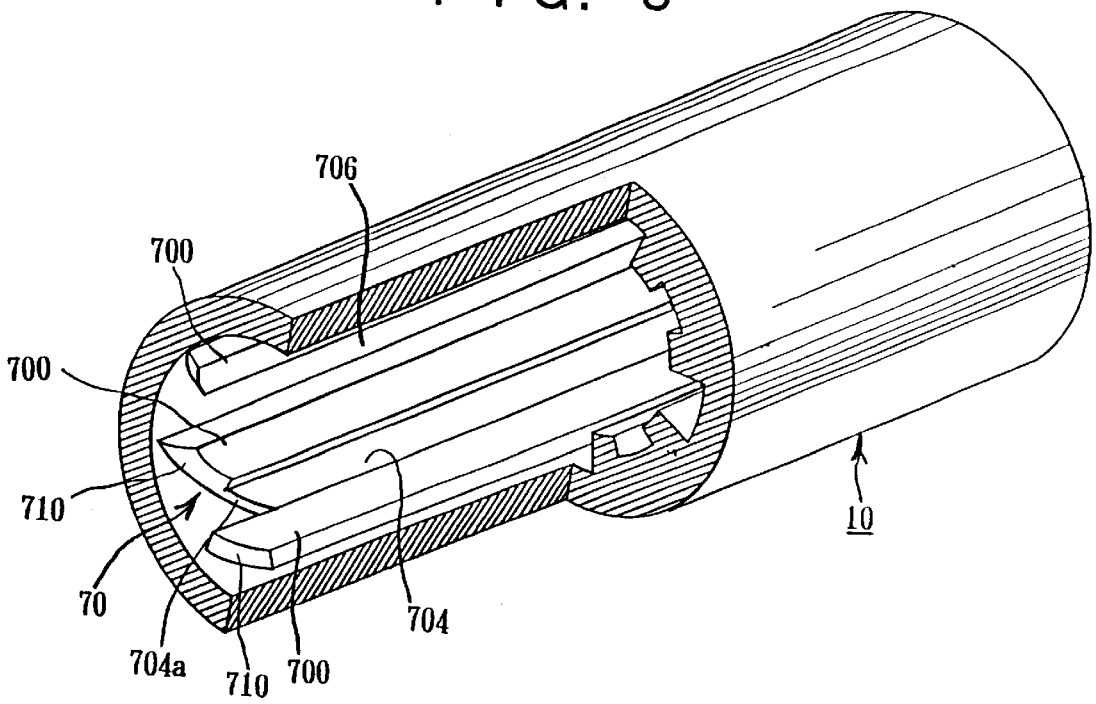
FIG. 8 is a schematic partially broken perspective view of a rear end portion of the barrel.
Figure 9:
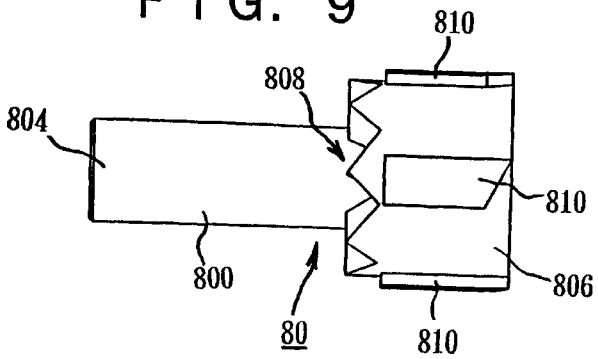
FIG. 9 is a schematic front view of a first cam element of the side knock-type ball point pen.
Figure 10:
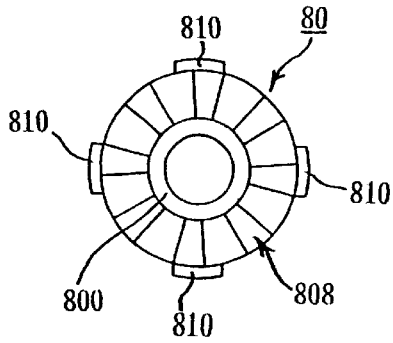
FIG. 10 is a schematic side view of the first cam element.

Referring now to FIGS. 7 and 8, the cam body 70 comprises axially extending ridge portions 700 which are provided on and spaced apart from one another around the inner peripheral portion of the barrel 10, first axially extending recess portions 704 between corresponding adjacent axially extending ridge portions 700, and second axially extending recess portions 706 between corresponding adjacent axially extending ridge portions 700. The first recess portions 704 and the second recess portions 706 are alternately disposed around the inner peripheral portion of the barrel 10. The second recess portions 706 are deeper than the first recess portions 704. Each of the second recess portions 706 has a bottom surface lying on the same surface as the inner surface of the barrel 10 does, whereas each of the first recess portions 704 has a bottom surface higher than the inner surface of the barrel 10. An edge 710 of each of the axially extending ridge portions 700 which is adjacent the front end of the barrel 10 is slanted and slopes in a rearward direction around the peripheral wall of the barrel 10. Similarly, an edge 704*a* of the bottom of each of the first recess portions 704 which is adjacent the front end of the barrel 10 is slanted at the same angle as the corresponding adjacent axially extending ridge portions 700 are done, and extends from the edge 710 of one of the corresponding adjacent axially extending ridge portions 700 to a side of the other of the corresponding adjacent axially extending ridge portions 700. As shown in FIG. 3, an inner circumferential step portion 160 is provided around the inner peripheral portion of the barrel 10 and disposed in close proximity to a rear portion of the cam body 70.

Figure 11:
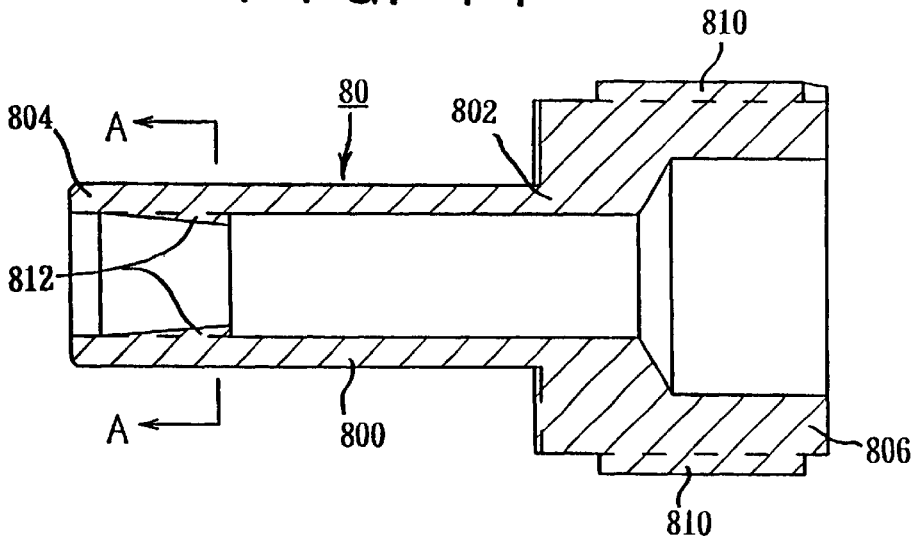
FIG. 11 is a schematic enlarged longitudinal sectional view of the first cam element.
Figure 12:
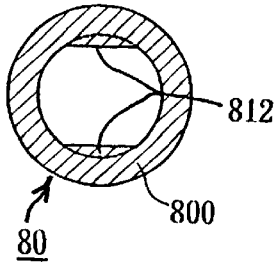
FIG. 12 is a schematic cross-sectional view of the first cam element, taken on a plane indicated in FIG. 11 by a line A—A.

Referring to FIGS. 9 to 12, there is illustrated the first cam element 80. The first cam element 80 comprises a substantially tubular body 800 having first and second ends 802, 804, and an enlarged outer diameter portion 806 provided around the first end 802 of the tubular body 800. The enlarged outer diameter portion 806 of the first cam element 80 has a saw-toothed edge 808 formed along an edge thereof, which is adjacent the first end 802 of the tubular body 800, and facing the second end 804 of the tubular body, and axially extending ridge portions 810 provided around an outer periphery of the enlarged outer diameter portion 806 and spaced apart from one another around the outer periphery of the enlarged outer diameter portion 806. As shown in FIGS. 11 and 12, the tubular body 800 of the first cam element 80 has a pair of thick-walled sections 812 at portions thereof which are adjacent the second end 804 of the tubular body 800 and opposite to each other.

Figure 13:
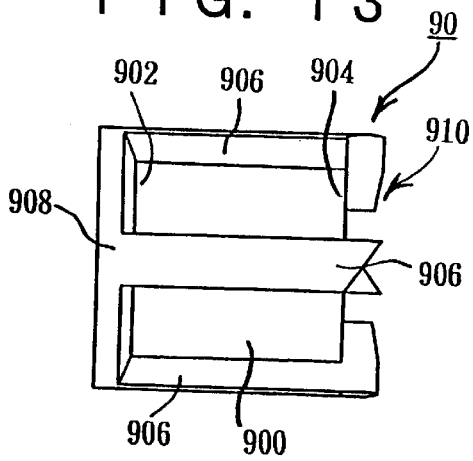
FIG. 13 is a schematic front view of a second rotary cam element of the side knock-type ball point pen.
Figure 14:
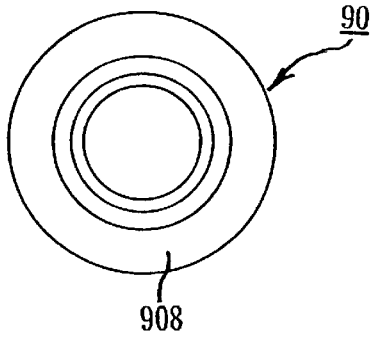
FIG. 14 is a schematic left side view of the second rotary cam element shown in FIG. 13.
Figure 15:
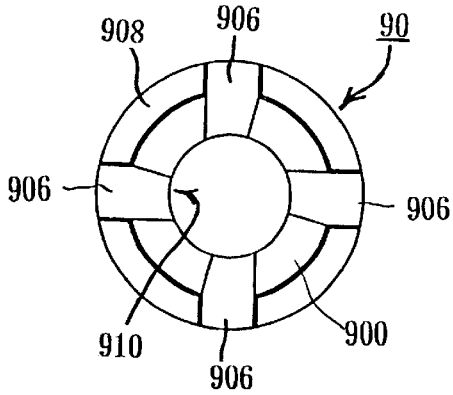
FIG. 15 is a schematic right side view of the second rotary cam element.

Referring to FIGS. 13 to 15, there is shown the second rotary cam element 90. The second rotary cam element 90 comprises a substantially tubular body 900 having first and second ends 902, 904, axially extending ridge portions 906 which are provided around an outer periphery of the tubular body 900, spaced apart from one another around the outer periphery of the tubular body 900, and extend along a total length of the tubular body 900, an outer circumferential rib 908 provided around the first end 902 of the tubular body 900, and a saw-toothed portion 910 formed along an edge of the second end 904 of the tubular body 900 which includes edges of the axially extending ridge portions 906.

Again referring to FIGS. 2, 3 and 7 to 15, the first cam element 80 is incorporated in the barrel 10 with the tubular body 800 thereof being mounted on or connected to the engaging protrusion 306 of the refill-receiver means 30 and with the axially extending ridge portions 810 thereof being engaged with the second recess portions 706 of the cam body 70 which are deeper than the first recess portions 704 of the cam body 70. The tubular body 800 of the first cam element 80 has the opposite thick-walled sections 812 as discussed above, so that the tubular body 800 is tightly mounted on the engaging protrusion 306 of the refill-receiver means 30. The axially extending ridge portions 810 of the first cam element 80 are engaged with the second recess portions 706 of the cam body 70 as described above, so that rotational movement of the first cam element 80 relative to the barrel 10 is prevented. The first cam element 80 is abutted against the circumferential step portion 160 of the barrel 10 due to an action of the first spring 130, whereby the first cam element 80 is prohibited to be separated from the cam body 70.

The second rotary cam element 90 is rotatably mounted on the tubular body 800 of the first cam element 80 with the saw-toothed portion 910 thereof facing the saw-toothed portion 808 of the first cam element 80 and with the axially extending ridge portions 906 thereof being engaged with the second recess portions 706 of the cam body 70. As shown in FIGS. 2 and 3, the second rotary cam element 90 has an inner circumferential step portion 912 provided around an inner peripheral portion of the tubular body 900 thereof. Disposed between the flange portion 304 of the refill-receiver means 30 and the inner circumferential step portion 912 of the second rotary cam element 90 is a second spring 170 which acts as means to facilitate rotational movement of the second rotary cam element 90 as will be described in greater detail hereinafter. Due to an action of the second spring 170, the saw-toothed portion 910 of the second rotary cam element 90 is abutted against the saw-toothed portion 808 of the first cam element 80. More particularly, vertices of the saw-toothed portion 808 of the first cam element 80 come into contact with areas between vertices and valley bottoms of the saw-toothed portion 910 of the second rotary cam element 90, and vertices of the saw-toothed portion 910 of the second rotary cam element 90 come into contact with areas between vertices and valley bottoms of the saw-toothed portion 808 of the first cam element 80. The second spring 170 is required to have force weaker than that of the first spring 130. If the force of the second spring 170 is stronger than that of the first spring 130, the second cooperating means 50 will be unable to perform a predetermined operation.

As shown in FIGS. 2 and 3, the actuating means 60 for causing the axially movable refill-receiver means 30 to be moved forwardly is pivotally supported at the opening portion 102 of the barrel 10. More particularly, the actuator means 60 has a substantially inverted U-shaped body in cross-section. The inverted U-shaped body of the actuator means 60 has notches 600 (only one notch 600 is shown in FIGS. 2 and 3) formed in both sides of the inverted U-shaped body. The actuator means 80 is fitted in the opening portion 102 of the barrel 10 with the notches 600 receiving a supporting projection 180 of the opening portion 102 of the barrel 10 and with a part of the actuator means 60 being in contact with the slant surface 312 of the enlarged outer diameter portion 302 of the refill-receiver means 30, so that the actuator means 60 can be pivoted radially relative to the barrel 10 when the actuator means 60 is pushed inwardly of the barrel 10 by a user. When the actuator means 60 is pushed inwardly of the barrel 10 by the user, the refill-receiver means 30 having the refill 40 received therein is forwarded, whereby the writing tip 402 is operatively projection out of the head section 20.

Figure 16:
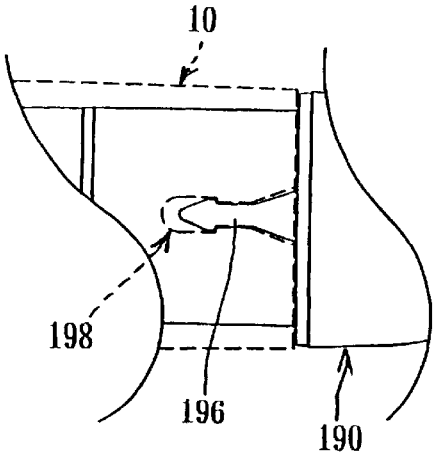
FIG. 16 is a schematic fragmentary view of a tail crown of the side knock-type ball point pen.

As shown in FIGS. 2 and 3, a tail crown 190 is fitted in the rear end portion of the barrel 10. The tail crown 190 includes a tubular body 192 having an opened end and a closed end, and a clip 194 for clipping the ball point pen to a shirt or jacket pocket or the like. The clip 194 is attached to and extends axially from a portion of an outer surface of the tubular body 192 which is adjacent the closed end of the tubular body 192. As best shown in FIG. 16, the tail crown 190 further has an engaging projection 196 of a substantially arrowhead-shape which is provided on a portion of the outer surface of the tubular body 192 which is opposite to the portion of the tubular body 192 to which the clip 194 is attached. Bearing on this, a notch 198 having a shape substantially identical to that of the engaging projection 196 is formed in the rear end of the barrel 10. The tail crown 190 is fitted in the rear end of the barrel 10 with the engaging projection 196 thereof being engaged with the notch 198 of the barrel 10, so that the tail crown 190 is prohibited to rotate relative to the barrel 10.

Figure 17:
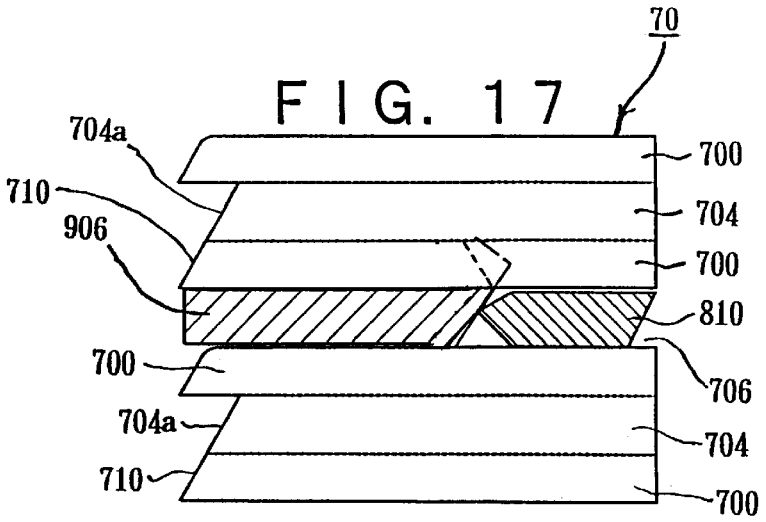
FIGS. 17 to 19 are schematic views of assistance in explaining the operation of second cooperating means of the side knock-type ball point pen.
Figure 18:
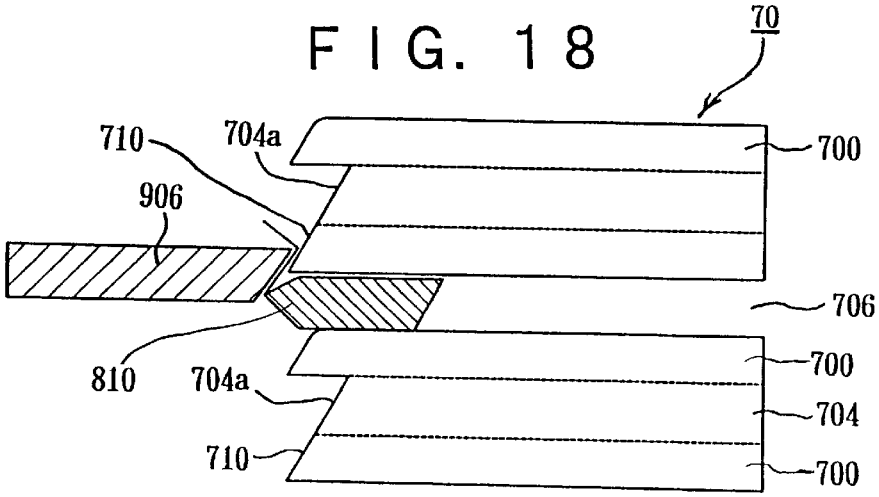
Figure 19:
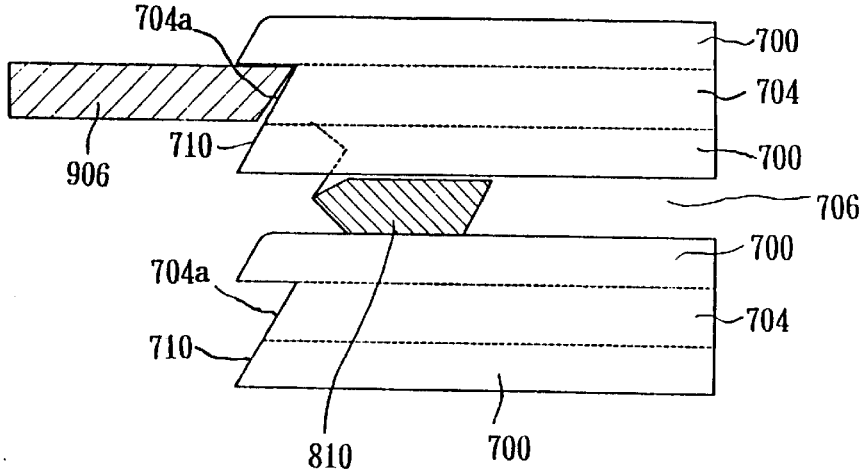

Referring to FIGS. 17 to 19, the operation of the ball point pen will be discussed hereinafter. When the actuator means 60 is pushed inwardly of the barrel 10 in order to cause the writing tip 402 of the refill 40 to be projected out of the head section 20, the refill-receiver means 30 having the refill 40 inserted therein is advanced. At this time, the first cam element 80 and the second rotary cam element 90 which are in a state shown in FIG. 17 are also forwarded while being guided by the second recess portions 706 of the cam body 70 with which the axially extending ridge portions 810 of the first cam element 80 and the axially extending ridge portions 906 of the second rotary cam element 90 are engaged. During the forward movement of the refill-receiver means 30, the axially extending ridge portions 906 of the second rotary cam element 90 are disengaged from the second recess portions 706 of the cam body 70. At this time, the second rotary cam element 90 comes into a state in which the second rotary cam element 90 can be freely rotated, and the second rotary cam element 90 is slightly rotated in such a manner that valley regions and crest regions of the saw-toothed portion 910 of the second rotary cam element 90 are allowed to be engaged with crest regions and valley regions of the saw-toothed portion 808 of the first cam element 80, respectively, as shown in FIG. 18, since the second rotary cam element 90 is abutted against the first cam element 80 by the action of the second spring 170 as described above. In this condition, the actuator means 60 is released from the pushing, the refill-receiver means 30 having the first and second cam elements 80, 90 coupled thereto is moved rearwardly due to the action of the first spring 130. As soon as the refill-receiver means 30 is moved rearwardly, slant edges of the axially extending ridge portions 906 of the second rotary cam element 90 are abutted against the slant edges 710 of the axially extending ridge portions 700 of the cam body 70 and guided by the slant edges 710 of the axially extending ridge portion 700 of the cam body 70 toward the slant edges 704*a* of the first recess portion 704 of the cam body 70, whereby the second rotary cam element 90 is rotated and the slant edges of the axially extending ridge portions 906 of the second cam rotary cam element 90 come into engagement with the slant edges 704*a* of the bottoms of the first recess portions 704 of the cam body 70 which are higher than the inner surface of the barrel 10, as shown in FIG. 19. As a result, the writing tip 402 of the refill 40 received in the refill-receiver means 30 is kept projected out of the head section 20 as shown in FIG. 3. In this condition, the user can use the ball point pen for writing. When the writing tip 402 is to be retracted in the barrel 10, the actuator means 60 is pushed inwardly of the barrel 10 to cause the refill-receiver means 30 to be advanced. During the forward movement of the refill-receiver means 30, the axially extending ridge portions 906 of the second rotary cam element 90 are disengaged from the edges 704*a* of the first recess portions 704 of the cam body 70. As soon as the axially extending ridge portions 906 of the second rotary cam element 90 are disengaged from the edges 704*a* of the first recess portions 704 of the cam body 70, the second rotary cam element 90 is slightly rotated in such a manner that the valley regions and crest regions of the saw-toothed portion 910 of the second rotary cam element 90 are allowed to be engaged with the crest regions and valley regions of the saw-toothed portion 808 of the first cam element 80, respectively. In this condition, when the actuator means 60 is released from the pushing, the axially extending ridge portions 906 of the second rotary cam element 90 are abutted against the slant edges 710 of the axially extending ridge portions 700 of the cam body 70 and guided toward the second recess portions 706 of the cam body 70 by the slant edges 710 of axially extending ridge portions 700 of the cam body 70, whereby the second rotary cam element 90 is rotated and the axially extending ridge portions 906 of the second rotary cam element 90 slip into the second recess portions 706 of the cam body 60. As a result, the writing tip 402 is retracted in the barrel 10.

Figure 20:
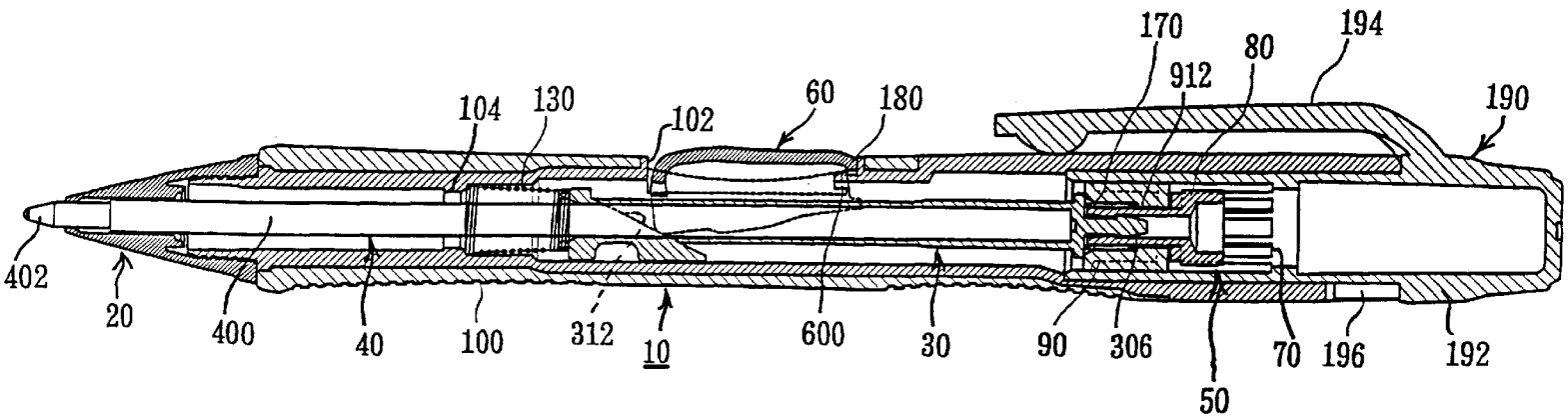
FIG. 20 is a schematic longitudinal sectional view of a side knock-type ball point pen according to a second embodiment of the present invention.
Figure 21:
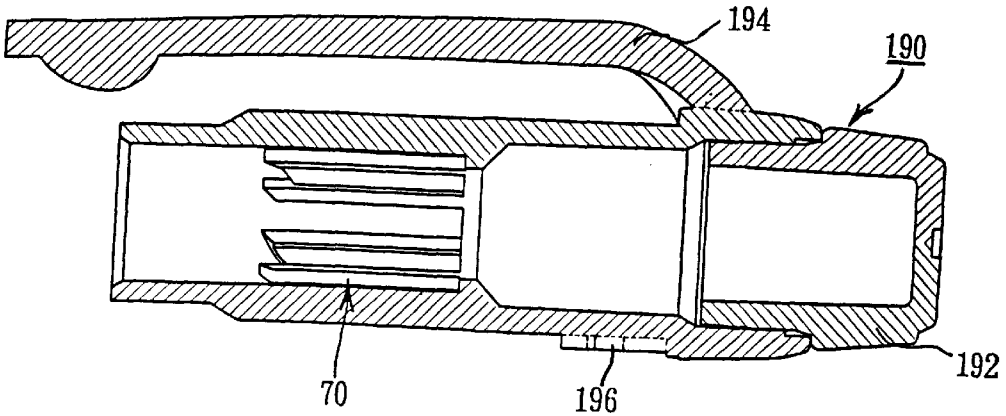
FIG. 21 is a schematic longitudinal sectional view of a tail crown of the side knock-type ball point pen shown in FIG. 20.

Referring to FIGS. 20 and 21, there is illustrated a second embodiment of the present invention. This embodiment is substantially similar to the first embodiment of FIGS. 2–19 except that the cam body 70 of the second cooperating means 50 is provided in an interior of the tubular body 192 of the tail crown 190. In the second embodiment of FIGS. 20 and 21, components which are substantially similar to those shown in FIGS. 2–19 are designated with like reference numerals and the description of them is not repeated. Similarly, the second embodiment is operated in the same manner as the first embodiment is done. Therefore, the description of the operation of the second embodiment is not repeated.

The terms and expressions which have been employed are used as terms of description and not of limitation, and there is no intention in the use of such terms and expressions of excluding any equivalents of the features shown and described, or portions thereof, but it is recognized that various modifications are possible within the scope of the invention claimed.

What is claimed is:

1. A side knock-type ball point pen comprising:

a barrel having a front end portion, and a rear end portion;

a head section provided at said front end portion of said barrel;

refill-receiver means axially movably incorporated within said barrel;

a refill removably received in said refill-receiver means, said refill comprising an ink container-tube, a writing tip attached to a front end of said ink container-tube, and ink contained in said ink container-tube;

a first spring incorporated within said barrel to always urge said refill-receiver means in a rearward direction;

actuator means provided at a portion of a peripheral wall of said barrel for causing said refill-receiver means to be advanced; and first cooperating means provided in an interior of said rear end portion of said barrel for keeping said writing tip of said refill projected out of said barrel during use of said ball point pen, said first cooperating means coupled to said refill-receiver means, said first cooperating means comprising:

a circumferential cam body formed around an inner peripheral portion of said barrel;

a first cam element incorporated within said barrel and engaged with said circumferential cam body;

a second rotary cam element incorporated within said barrel and disengageably engaged with said circumferential cam body and said first cam element; and a second spring disposed between said first cam element and said second rotary cam element for facilitating rotational movement of said second rotary cam element relative to said first cam element when said second rotary cam element is disengaged from said circumferential cam body, said second spring having a force weaker than that of said first spring.

2. The side knock-type ball point pen as claimed in claim 1, wherein said refill-receiver means is coupled to said first cooperating means through a connecting member provided at said refill-receiver means.

3. The side knock-type ball point pen as claimed in claim 2, wherein said connecting member comprises an engaging projection provided at a rear end of said refill-receiver means and said first cam element has a substantially tubular body, said refill-receiver means being coupled to said first cam element by causing said substantially tubular body to be mounted on said engaging projection.

4. The side knock-type ball point pen as claimed in claim 1, further comprising:

second cooperating means on said barrel and said refill-receiver means for preventing said refill-receiver means from rotating relative to said barrel.

5. The side knock-type ball point pen as claimed in claim 4, wherein said second cooperating means comprises guide grooves formed in said refill-receiver means, and ribs provided on an inner surface of said barrel, said guide grooves and said ribs being engaged with each other, whereby said refill-receiver means is prevented from rotating relative to said barrel.

6. The side knock-type ball point pen as claimed in claim 4, wherein said second cooperating means comprises guide grooves formed in an inner surface of said barrel, and ribs provided on said refill-receiver means, said guide grooves and said ribs being engaged with each other, whereby said refill-receiver means is prevented from rotating relative to said barrel.

7. The side knock-type ball point pen as claimed in claim 1, wherein said refill-receiver means comprises a cylindrical body, said cylindrical body having holes formed in a peripheral wall of said cylindrical body, and inwardly protruding portions provided on an inner surface of said cylindrical body, said holes and said inwardly protruding portions being alternately disposed around said peripheral wall of said cylindrical body.

8. The side knock-type ball point pen as claimed in claim 1, further comprising:

a tail crown mounted in said rear end portion of said barrel, said tail crown having a clip for clipping said ball point pen to an article of clothing.

9. The side knock-type ball point pen as claimed in claim 1, further comprising:

a tail crown mounted in said rear end portion of said barrel, said first cooperating means provided in an interior of said tail crown.

10. The side knock-type ball point pen as claimed in claim 9, wherein said tail crown has a clip for clipping said ball point pen to an article of clothing.

11. The side knock-type ball point pen as claimed in claim 1, wherein said refill-receiver means comprises a cylindrical body, and an enlarged outer diameter portion provided around said cylindrical body, said enlarged outer diameter portion having a slant surface which is inclined relative to a longitudinal axis of said cylindrical body and slopes in a rearward direction, and a part of said actuator means being in contact with said slant surface of said refill-receiver means.

12. The side knock-type ball point pen as claimed in claim 11, wherein said enlarged outer diameter portion has laterally protruding projections provided at both sides thereof, said refill-receiver means being in point-contact with an inner surface of said barrel at said laterally protruding projections.

* * * * *